US011612976B2

(12) United States Patent
Klug

(10) Patent No.: US 11,612,976 B2
(45) Date of Patent: Mar. 28, 2023

(54) DEVICE FOR GRINDING SAW TEETH AND A CORRESPONDING METHOD

(71) Applicant: GEORG KESEL GMBH & CO. KG, Kempten (DE)

(72) Inventor: Martin K. Klug, Haldenwang (DE)

(73) Assignee: GEORG KESEL GMBH & CO. KG, Kempten (DE)

( * ) Notice: Subject to any disclaimer, the term of this patent is extended or adjusted under 35 U.S.C. 154(b) by 701 days.

(21) Appl. No.: 16/665,456

(22) Filed: Oct. 28, 2019

(65) Prior Publication Data

US 2020/0156203 A1 May 21, 2020

(30) Foreign Application Priority Data

Nov. 15, 2018 (DE) ..... 102018128684.8

(51) Int. Cl.
*B24B 19/00* (2006.01)
*B24B 41/06* (2012.01)

(52) U.S. Cl.
CPC ..... *B24B 19/009* (2013.01); *B24B 41/066* (2013.01)

(58) Field of Classification Search
CPC .. B24B 3/361; B24B 3/38; B24B 3/58; B24B 3/583; B24B 3/586; B23D 63/12; B23D 63/126; B23D 63/08; B23D 63/14
See application file for complete search history.

(56) References Cited

U.S. PATENT DOCUMENTS 2,610,452 A * 9/1952 Hill ..... B24B 5/162 451/238
2,725,698 A * 12/1955 Hill ..... B24B 3/583 451/45
2,807,256 A * 9/1957 Woolley ..... B23D 59/025 451/449
2,865,140 A * 12/1958 Shumway ..... B24B 3/38 451/340
2,997,821 A * 8/1961 Dixon ..... B24B 3/38 451/367
3,127,717 A * 4/1964 Sommers ..... B24B 3/38 451/367
3,553,894 A * 1/1971 Sjostrom ..... B24B 53/07 451/72
4,040,313 A * 8/1977 Lustgraaf ..... B23D 63/14 451/238
5,257,563 A * 11/1993 Hutchinson ..... B23D 63/10 76/80.5

(Continued)

FOREIGN PATENT DOCUMENTS

CH 701519 A2 1/2011
DE 3537059 A1 5/1986

(Continued)

*Primary Examiner* — Joel D Crandall
(74) *Attorney, Agent, or Firm* — Notaro, Michalos & Zaccaria P.C.

(57) ABSTRACT

A device for grinding hard metal-tipped teeth of saw bands having a feed device for feeding a temporary workpiece in a timed manner where the temporary workpiece is formed from a plurality of saw bands that are parallel to one another, also having a clamping device that clamps the plurality of saw bands against one another, further having a grinding unit for simultaneously grinding a plurality of teeth, where the grinding unit has a grinding wheel having a plurality of grinding profiles, and a corresponding method.

8 Claims, 7 Drawing Sheets

(56) References Cited

Figure 1:
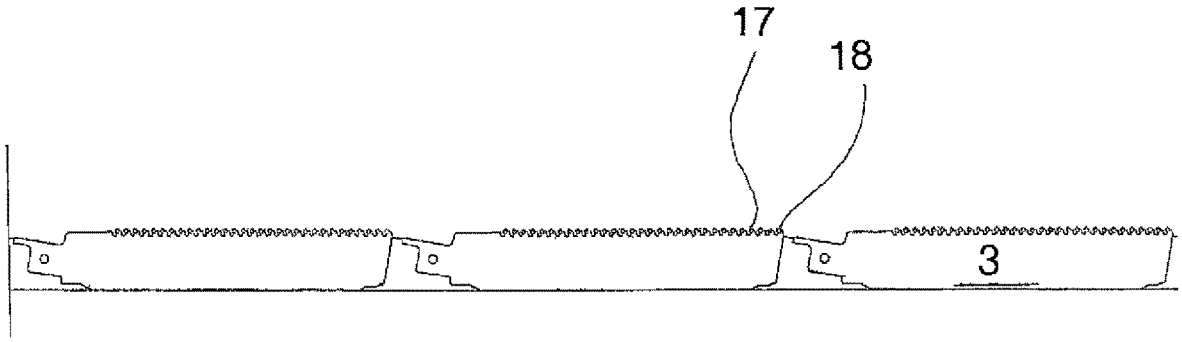

U.S. PATENT DOCUMENTS 5,775,180 A * 7/1998 Parke ..... B24B 3/36
76/85

FOREIGN PATENT DOCUMENTS

| | | | | | |
|---|---|---|---|---|---|
| DE | 19808339 | A1 * | 9/1999 | ..... | B23D 63/00 |
| DE | 10121370 | A1 | 11/2002 | | |
| FR | 2717725 | A1 * | 9/1995 | ..... | B24B 17/10 |
| WO | 9605931 | A1 | 2/1996 | | |

* cited by examiner

DEVICE FOR GRINDING SAW TEETH AND A CORRESPONDING METHOD

The present invention relates to a device for grinding saw teeth tipped with hard metal and to a corresponding method.

In the chip removal, hard metal-tipped saw blades and saw bands are of high economic significance and are used expansively. In trade, two-handed electrical saber saws are often used for perpendicular cuts, the hard metal-tipped cutting edges of which make them suitable for severing tree roots in the ground, for disassembling structural components, for metal cutting by the fire department and other rescue organizations, as well as for the severing of metals. However, such saw blades and saw bands are also used in the industry for machining metals, plastics or wood. Correspondingly high demands are made on the precision of the tooth geometries, which can thus not be adjusted with the required precision using normal milling processes.

Hard metal-tipped saw blades as well as bands have a large variability with respect to the tooth width and the tooth geometry. They are initially made of a blank, in that a metal band is unrolled from a coil, is optionally rotated and aligned. Raw teeth are milled into this metal band and hard metal pins are subsequently welded on in the transition area between future tooth face and future tooth back. These hard metal pins are then ground to size in a grinding machine, for the purpose of which diamond grinding wheels are commonly used. After this operating step, tooth face and tooth back are at the final dimension. Depending on the tooth pitch and wedge angle to be produced, a corresponding diamond grinding wheel is used thereby. A grinding of the two side surfaces of the future saw band takes place subsequently, optionally followed by a cutting to the desired length of the finished saw blade or band. The unrolling of the blank from the coil as well as the further operating steps typically follow in a timed manner, at least within those operating steps, by means of which a hard metal-tipped saw blade/saw band, which is to be manufactured, is processed continuously. Buffer paths between the individual processing stations (machines) have to optionally be planned thereby, if the timing cannot be maintained throughout the entire manufacturing line.

The correct grain of the grinding wheels, adapted grinding parameters, as well as an optimal grinding pressure are important parameters for the grinding process on the tooth. Due to the required high precision, it was previously known to use corresponding grinding machines, which in each case process a hard metal-tipped tooth of a saw blade with respect to tooth face and back by means of grinding. The manufacturing time per tooth is thereby usually several seconds, because the hard metal layer thickness to be removed can often not be removed by means of a single feed process of the grinding wheel. It is thus known to use a plurality of such processing machines, in order to be able to simultaneously process a plurality of bands.

The present invention has the object of specifying a more efficient device and a more efficient method for grinding teeth.

The device object is solved by means of a device for grinding hard metal-tipped teeth of saw bands, having a feed device for feeding a temporary workpiece in a timed manner, wherein the temporary workpiece is formed from a plurality of saw bands, which are parallel to one another, further having a clamping device, which clamps the plurality of saw bands against one another, further having a grinding unit for simultaneously grinding a plurality of teeth, wherein the grinding unit has a grinding wheel comprising a plurality of grinding profiles. The provision according to the invention of a plurality of grinding profiles on a grinding wheel, in particular a grinding wheel embodied in a roller-shaped manner, which has a variety of tooth face grinding profiles and tooth back grinding profiles, has the highly advantageous result that a block, forming a temporary workpiece, of a variety of parallel saw bands, which are aligned axially, can be processed simultaneously, thus that a plurality of teeth of a saw band, which in particular directly succeed one another, can be processed simultaneously, wherein the grinding wheel also processes the teeth of the saw bands, which are parallel, adjacent to this saw band, of the temporary workpiece. A plurality of feed processes of the grinding wheel are thereby usually required before, firstly, the tooth face, and then the tooth back are at the final dimension. The clamping device ensures that the teeth, which are parallel to one another, of the plurality of saw bands, are manufactured with the same manufacturing quality. Even though a longer processing time is thereby required for each temporary workpiece, the variety of identically produced teeth according to the invention leads to a significantly lower manufacturing time per tooth.

In an embodiment of the device, it is provided that it has a push-down unit and/or a timing unit and/or a cutting unit. The push-down unit ensures that all tooth backs have the same height above the tooth base, the timing unit advantageously ensures that each temporary workpiece is guided through the device at the correct measured time, and the cutting unit provides for the cutting of saw bands, which are manufactured to the final dimension, if saw blades are to be created. The timing unit is thereby preferably formed by an, in particular conical engagement mandrel, which simultaneously engages with the correspondingly shaped recesses of each saw band.

In an embodiment of the invention, it is further provided that it has spacers, preferably band-shaped spacers, which can in particular be inserted between two adjacent saw bands of a workpiece, particularly preferably segment-shaped spacers, which are arranged in the clamping device in a stationary manner. It is attained by means of this advantageous embodiment that the hard metal pins, which optionally protrude beyond the thickness of the saw band, do not lead to a negative impact of the processing of the adjacent saw band in the temporary workpiece. The thickness of the spacers thereby preferably corresponds to at least twice the tolerances of the length of the hard metal pins. The spacers are thereby in particular band-shaped spacers, preferably rotating, but, according to the invention, preferably segment-shaped spacers, which are arranged in the clamping device in a stationary manner.

Finally, it is advantageously also provided that the device combines between 2 and 80, in particular between 5 and 60, preferably between 20 and 40 metal bands, to form a temporary workpiece.

The device object is solved by means of a method for grinding hard metal-tipped teeth of saw bands, having the steps of: —clamping a plurality of parallel saw bands, which are aligned axially to one another, against one another to create a temporary workpiece, —simultaneously grinding the temporary workpiece at a plurality of locations, which are axially spaced apart, —further transporting the processed temporary workpiece, and re-clamping to create a new temporary workpiece. The simultaneous grinding according to the invention of a variety of raw teeth of a bundle of individual saw bands along an axial section of these saw bands highly advantageously leads to very short tooth processing times. During a processing time of several minutes of the variety of raw teeth of the temporary workpiece, significantly more than 1,000 teeth are often completed, depending on the tooth geometry to be manufactured.

In an embodiment of the method, it is provided that it further has one or a plurality of the following steps: —pre-milling of raw teeth in desired areas of the metal band, —unrolling a plurality of metal bands, each comprising pre-milled raw teeth and welded-on hard metal pins from a coil each, —rotating and aligning the respective metal bands, —inserting spacers between two adjacent metal bands, —pushing down a temporary workpiece during the grinding, —rolling up a plurality of processed metal bands to form a coil each.

In an embodiment of the method, it is provided that it has a step of cutting instead of rolling up a processed metal band.

The invention will be described in an exemplary manner in a preferred embodiment with reference to a drawing, wherein further advantageous details of the figures can be gathered from the drawing. Functionally identical parts are thereby provided with identical reference numerals.

Figure 2A:
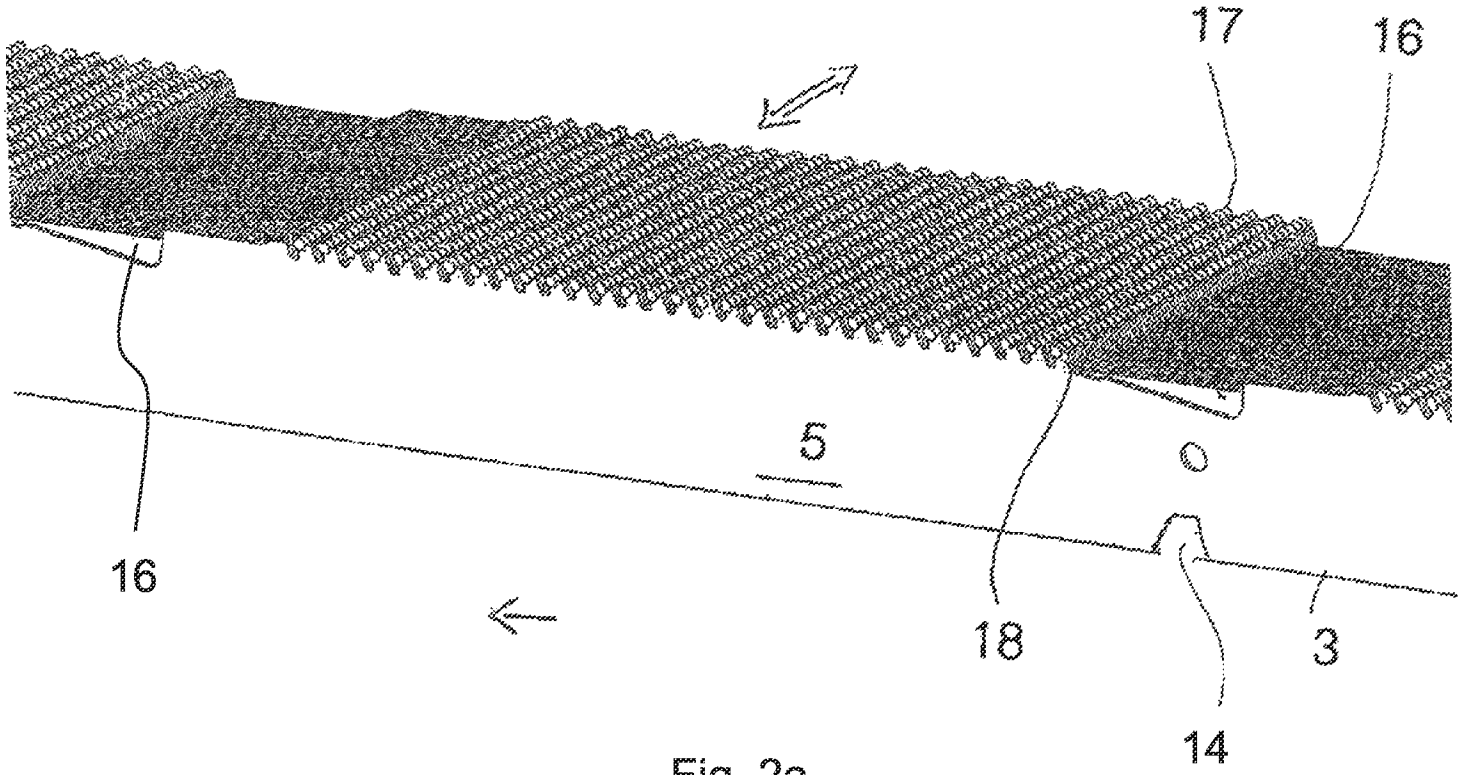
Figure 2B:
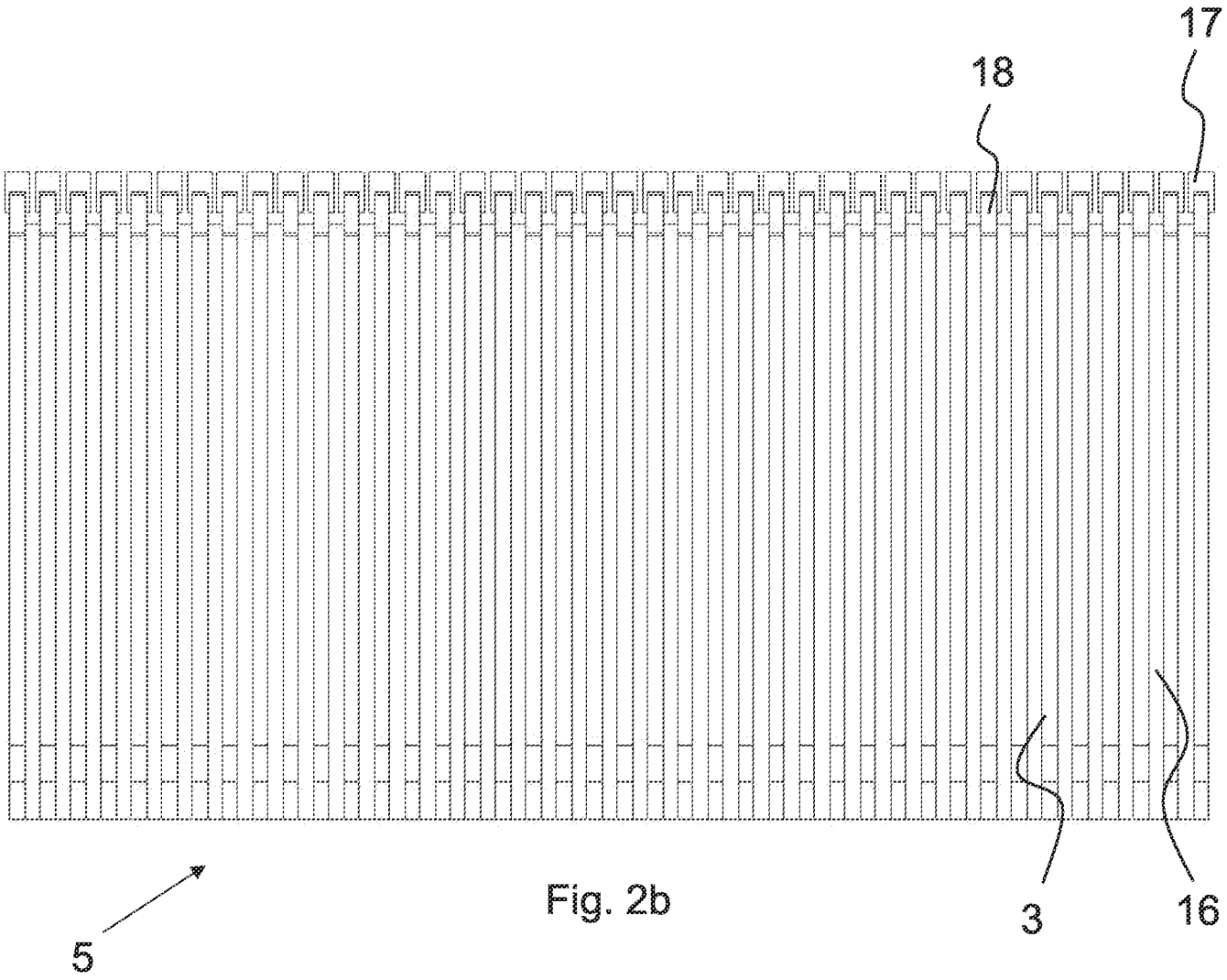
Figure 3:
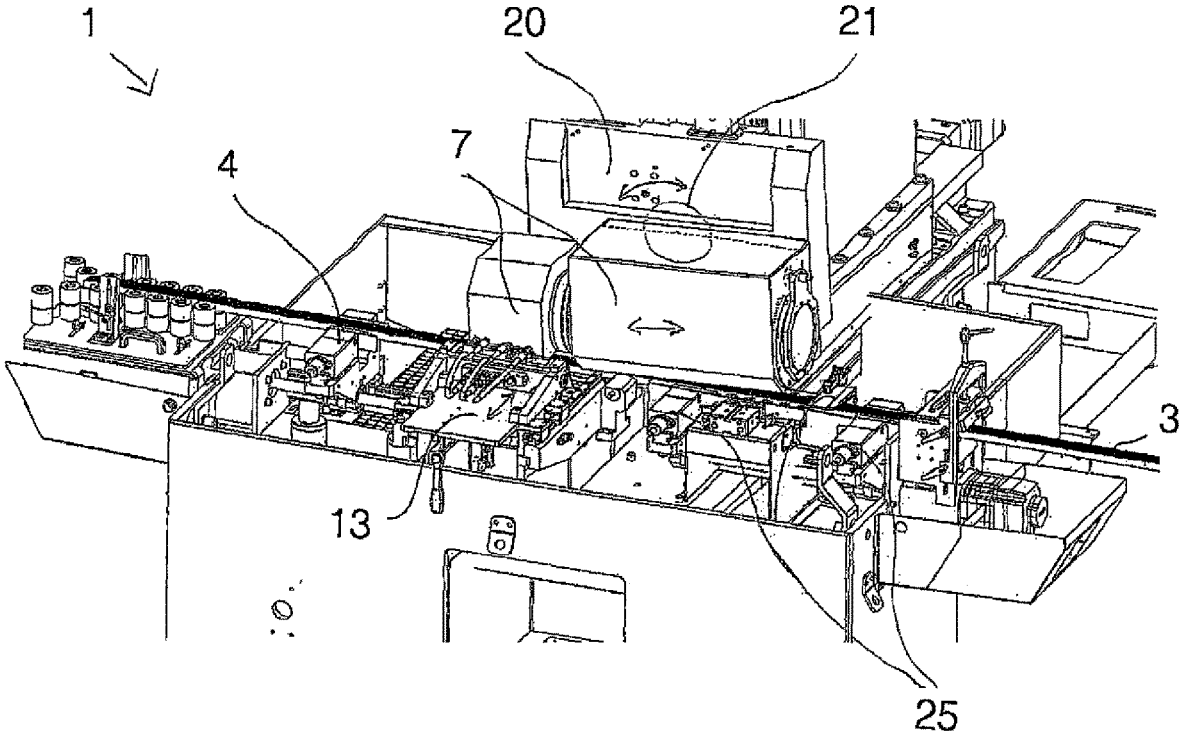
Figure 4:
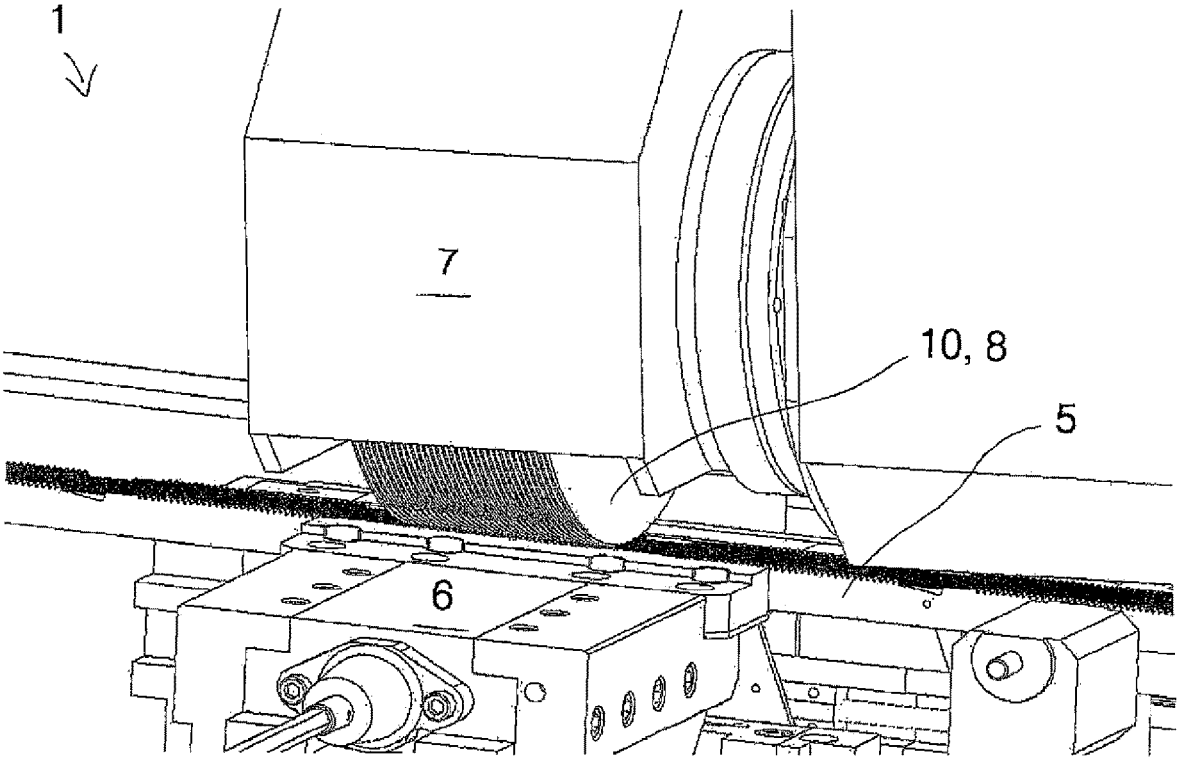
Figure 5:
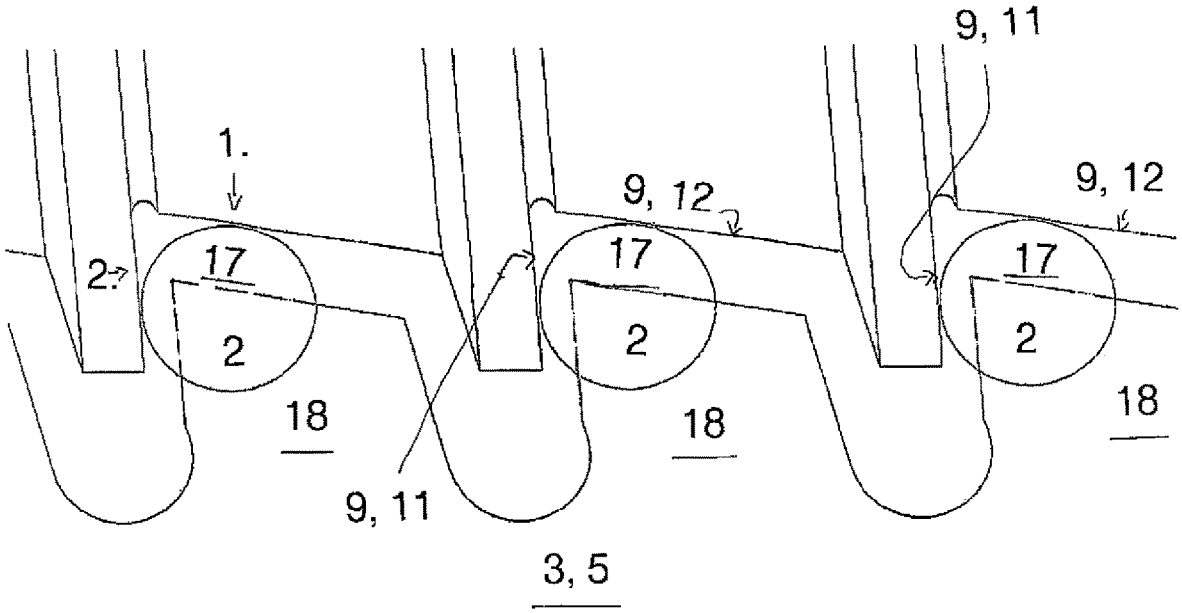

In detail, the figures of the drawings show:

FIG. 1 a metal band in the raw state,

FIG. 2 a temporary workpiece of 40 metal bands,

FIG. 3 a partial view of a device according to the invention,

FIG. 4 a detail view of the grinding unit,

FIG. 5 a detail of a grinding wheel, and

Figure 6:
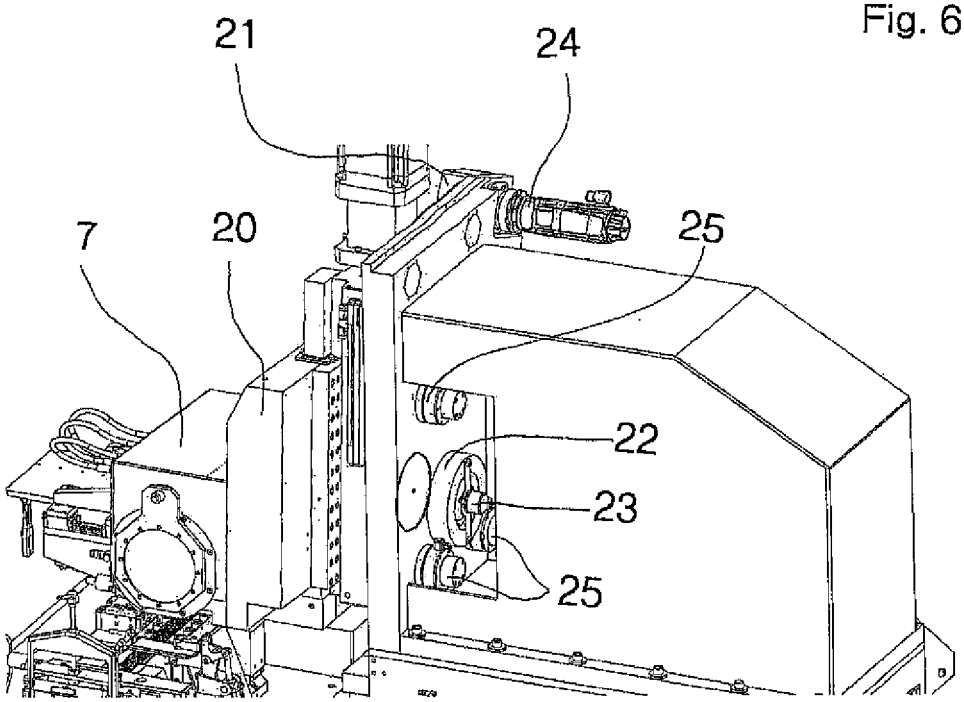

FIG. 6 a further partial view of the device according to the invention.

FIG. 1 shows a metal band in the state prior to a processing by the device according to the invention, which is already referred to as saw band 3 here, even if it is still in the raw state. Milled-in raw teeth 18, already comprising welded-on hard metal pins 17 in the area between the later tooth face and the tooth back can be seen. A further advantage of the invention can be recognized, namely that raw teeth 18 are milled in specifically only into certain areas of the saw band 3, namely into those, which are later processed into saw blades by means of a cutting unit. This reduces the manufacturing time, because no teeth need to be milled in at the areas, which are omitted later. According to the invention, such a pre-milled band, which is provided with hard metal pins 17, is unrolled from a coil or is fed to a device according to the invention after the weld-on.

FIG. 2 shows a temporary workpiece 5, formed here from 40 saw bands 3, which are parallel to one another, in the raw state. Between said saw bands 39 spacers 16, thus one spacer 16 each between two adjacent saw bands 3, are located. The individual saw bands 3 of the temporary workpiece 5 are aligned axially to one another, so that a grinding process transversely to the longitudinal direction of the saw bands can take place, in the case of which all teeth of all saw bands 3 can be manufactured with the same dimension. The feed direction is identified with an arrow, the processing direction with a double arrow, because, according to the invention, the processing takes place orthogonally in both directions to the longitudinal axis. A timing unit 14, which is embodied here as recess in a saw band 3, can also be seen. According to the invention, a correspondingly shaped mandrel engages with these recesses, which are also aligned and flush, and thus ensures for each positive connection that the orientation of the bands relative to one another is also maintained after clamping.

FIG. 3 shows a device 1 according to the invention in partial view. A bundle of 40 parallel saw bands 3 here is conveyed into the device 1, arriving from the right. A clamping device 6, which is not shown here, clamps the bundle of saw bands 3 in the area of the grinding unit 7 and thus creates a temporary workpiece 5 during the grinding process. The clamping device 6 is covered by the push-down unit 13. Said temporary workpiece 5 is pushed onto a defined support by means of a, in particular multi-finger push-down unit 13, so that a defined, dimensionally stable tooth tip height can be attained across all teeth. The push-down unit 13 is embodied so as to be displaceable and can thus be displaced into a non-interfering position outside of a grinding process area after the push-down and the clamping of the saw blades/bands. A supply device 25 is illustrated on the right.

A feed device 4 is illustrated on the left in FIG. 3, wherein the clamping of the temporary workpiece is released in response to the timed conveying through the device 1, while the feed device 4 already clamps the saw band bundle. Said feed device 4 then further conveys the saw band bundle, stops, releases the clamping, whereupon the clamping unit 6, in turn, clamps in the operating area of the grinding unit 7 and thus creates a temporary workpiece 5. By means of this intermittingly changing clamping, a timed transport is ensured on the one hand, and, on the other hand, a precise grinding process is made possible. A base plate 19 for the grinding unit 7 as well as a pivoting device 20 are illustrated, the movements are suggested by means of arrows.

FIG. 4 shows a detail view of the grinding wheel 8 according to the invention of the grinding unit 7 in installed position in the device 1 according to the invention, as well as the clamping device 6. The grinding wheel 8 is embodied as roller 10, the grinding profile of which is embodied according to the tooth pitch to be manufactured. When changing the tooth geometry to be manufactured, the grinding wheel 8 has to be changed as well. It can be seen well that all raw teeth below the grinding wheel 8 of a saw band 3 of the temporary workpiece 5 are ground simultaneously, wherein the grinding wheel 8 is moved transversely to the longitudinal direction of the workpiece 5, in order to process all of the teeth of a saw band section within the grinding wheel operating width.

FIG. 5 shows a section of a grinding wheel 8 according to the invention as roller 10, as well as a corresponding section of a saw band 3 comprising raw teeth 18 and hard metal pins 17, which are welded on in each case. Finished teeth 2, which are embodied with a wedge angle, are depicted by means of dashes. The grinding wheel 8 has a grinding profile 9, formed by a plurality of identical tooth face grinding profiles 11 and identical tooth back grinding profiles 12. A possible processing sequence is specified by means of numbered arrows, according to which a grinding of the tooth back takes place first by means of the tooth back grinding profiles 12, in particular in a plurality of feed steps, wherein the grinding wheel 8 performs a movement in the direction behind the drawing plane, in order to process all parallel saw bands 3 of the temporary workpiece 5 in the processing section. For the sake of clarity, they are not indicated. A grinding process of the tooth face with the tooth face grinding profiles 11 takes place subsequently. This is identified by means of the arrow 2. A reverse processing sequence is also in accordance with the invention.

FIG. 6 shows a further view of a device 1 according to the invention. The base plate 19 for the grinding unit 7 as well as a pivoting device 20 comprising a drive 23 can be seen. A pivot bearing 21 and three fastening devices 24 as well as a rotary encoder 22 for the pivoting device 20 are illustrated. The grinding unit 7 is moved and the temporary workpiece is created by means of these assembly groups.

As a function of the different tooth geometries to be manufactured, in particular relating to the clamping angle at the tooth face and the free angle at the tooth back, the grinding unit 7 is pivoted about a corresponding angle by means of a pivoting device 20, which is arranged downstream from the base plate 19 (on which the grinding unit 7 is mounted).

The pivoting device 20 consists of a stable pivot bearing 21 comprising a high-resolution rotary encoder 22 for the exact angle adjustment as well as an NC-controlled drive 23 (pivoting movement initiated via a tooth pinion and a tooth segment) as well as an automatic fastening device 24.

To support the unrolling process of the individual coils on the inlet side, a supply device 26, which is timed with the same timing as the feed device 4, is provided to the right of the clamping device 6.

The supply device 25, as does the feed device 4, consists of a clamping unit, a guide unit, and of a drive unit.

Tooth processing times are thus reached by means of the invention, which are below the current processing times by a factor of 10 or more, even if up to several minutes of processing time are required for each temporary workpiece. Due to the fact that thereby often more than 1,000 teeth are completed simultaneously, or even more depending on the tooth geometry, the tooth processing times are accordingly short.

In a highly advantageous manner, the grinding process according to the invention allows for high manufacturing speeds with simultaneously ensured highest processing precision, for the purpose of which a grinding wheel and a saw band bundling had to be developed.

For this purpose, the core method according to the invention consists of the steps of clamping a plurality of parallel saw bands, which are aligned axially to one another, against one another to create a temporary workpiece, simultaneously grinding the temporary workpiece at a plurality of locations, which are axially spaced apart, and further transporting the processed temporary workpiece, and re-clamping to create a new temporary workpiece. The following steps are added for a complete manufacturing process: pre-milling of raw teeth in desired areas of the metal band, unrolling a plurality of metal bands, each comprising pre-milled raw teeth and welded-on hard metal pins, from a coil each, rotating and aligning the respective metal bands, inserting spacers between two adjacent metal bands, pushing down a temporary workpiece during the grinding as well as after the core steps rolling up of a processed metal band to form a coil, alternatively cutting of a processed metal band instead of it rolling up.

LIST OF REFERENCE NUMERALS

1 device
2 tooth
3 saw band
4 feed device
5 temporary workpiece
6 clamping device
7 grinding unit
8 grinding wheel
9 grinding profile
10 roller
11 tooth face grinding profile
12 tooth back grinding profile
13 push-down unit
14 timing unit
16 spacer
17 hard metal pin
18 raw tooth
19 base plate grinding unit
20 pivoting device
21 pivot bearing
22 rotary encoder
23 drive
24 fastening device
25 supply device

The invention claimed is:

1. A device (1) for grinding a plurality of hard metal-tipped teeth (2) of each of a plurality of saw bands (3), the device having a feed device (4) for feeding a temporary workpiece (5) in a timed manner, wherein the temporary workpiece (5) is formed from the plurality of saw bands (3), which are parallel to one another, wherein the device (1) for grinding has spacers (16), wherein the spacers (16) are inserted between two adjacent saw bands (3) of the temporary workpiece (5), the device (1) for grinding further having a clamping device (6), wherein the clamping device (6) clamps the plurality of saw bands (3) towards one another and against the spacers (16), the device (1) for grinding further having a grinding unit (7) for simultaneously grinding a plurality of teeth (2), wherein the grinding unit (7) has a grinding wheel (8) comprising a plurality of grinding profiles (9).

2. The device (1) according to claim 1, characterized in that the grinding wheel (8) is embodied as a roller (10), wherein the plurality of grinding profiles (9) has at least one tooth face grinding profile (11) and at least one tooth back grinding profile (12).

3. The device (1) according to claim 1 or 2, characterized in that the device (1) has a pushdown unit (13) or a timing unit (14) or a cutting unit.

4. The device (1) according to one of the preceding claims, characterized in that the spacers (16) are band-shaped spacers (16) or segment-shaped spacers (16), wherein the spacers (16) are arranged in the clamping device (6) in a stationary manner.

5. The device (1) according to claim 1, characterized in that the device (1) combines between 2 and 80 metal bands, to form the temporary workpiece (5).

6. The device (1) according to claim 1, characterized in that the device (1) has a pushdown unit (13) and a timing unit (14) and a cutting unit.

7. A method for grinding hard metal-tipped teeth of saw bands, having the steps of:

clamping a plurality of parallel saw bands, which are aligned axially to one another, wherein the axes of each of the plurality of saw bands are aligned in the same direction, wherein spacers are inserted between two adjacent saw bands to create a temporary workpiece, simultaneously grinding the temporary workpiece at a plurality of locations, which are axially spaced apart, further transporting the processed temporary workpiece and reclamping the temporary workpiece to create a new temporary workpiece.

8. The method according to claim 7 further having one or a plurality of the following steps:

pre-milling of raw teeth in desired areas of the metal band, unrolling a plurality of metal bands, each comprising pre-milled raw teeth and welded-on hard metal pins from a coil, rotating and aligning the respective metal bands, inserting spacers between two adjacent metal bands, pushing down the temporary workpiece before the clamping, rolling up at least one of the processed metal bands to form a coil each or cutting the processed metal bands.

* * * * *